US006959925B1

(12) United States Patent
Baker et al.

(10) Patent No.: US 6,959,925 B1
(45) Date of Patent: Nov. 1, 2005

(54) AUTOMATIC CARD SHUFFLER

(75) Inventors: Thompson Baker, Meridian, ID (US); Steven J. Blad, Henderson, NV (US); Lynn Hessing, Boise, ID (US); Phil Price, Boise, ID (US); Carl W. Price, Boise, ID (US)

(73) Assignee: VendingData Corporation, Las Vegas, NV (US)

( * ) Notice: Subject to any disclaimer, the term of this patent is extended or adjusted under 35 U.S.C. 154(b) by 133 days.

(21) Appl. No.: 10/757,785

(22) Filed: Jan. 14, 2004

Related U.S. Application Data

(63) Continuation of application No. 10/226,394, filed on Aug. 23, 2002, now Pat. No. 6,698,756.

(51) Int. Cl.[7] ..... A63F 1/12

(52) U.S. Cl. ..... 273/149 R; 273/292; 463/12; 463/25; 463/29

(58) Field of Search ..... 273/149 R, 292; 463/12, 25, 29

(56) References Cited

U.S. PATENT DOCUMENTS

| | | | | |
|---|---|---|---|---|
| 3,589,730 | A | 6/1971 | Slay | |
| 4,515,367 | A | 5/1985 | Howard | |
| 4,659,082 | A | 4/1987 | Greenberg | |
| 4,770,421 | A | 9/1988 | Hoffman | |
| 4,807,884 | A | 2/1989 | Breeding | |
| 5,275,411 | A * | 1/1994 | Breeding | 273/149 R |
| 5,303,921 | A | 4/1994 | Breeding | |
| 5,584,483 | A * | 12/1996 | Sines et al. | 273/149 R |
| 5,676,372 | A * | 10/1997 | Sines et al. | 273/149 R |
| 5,718,427 | A | 2/1998 | Cranford et al. | |
| 6,019,368 | A | 2/2000 | Sines et al. | |
| 6,068,258 | A | 5/2000 | Breeding et al. | |
| 6,139,014 | A | 10/2000 | Breeding et al. | |
| 6,149,154 | A | 11/2000 | Grauzer et al. | |
| 6,250,632 | B1 | 6/2001 | Albrecht | |
| 6,254,096 | B1 | 7/2001 | Grauzer et al. | |
| 6,299,167 | B1 | 10/2001 | Sines et al. | |
| 6,325,373 | B1 | 12/2001 | Breeding et al. | |
| 6,582,301 | B2 | 6/2003 | Hill | |
| 6,698,756 | B1 * | 3/2004 | Baker et al. | 273/149 R |
| 2002/0017481 | A1 | 2/2002 | Johnson et al. | |
| 2002/0063389 | A1 | 5/2002 | Breeding et al. | |
| 2003/0042673 | A1 | 3/2003 | Grauzer et al. | |
| 2003/0052449 | A1 | 3/2003 | Grauzer et al. | |
| 2003/0052450 | A1 | 3/2003 | Grauzer et al. | |
| 2003/0073498 | A1 | 4/2003 | Grauzer et al. | |

(Continued)

*Primary Examiner*—Gregory Vidovich
*Assistant Examiner*—Dolores R. Collins
(74) *Attorney, Agent, or Firm*—Quirk & Tratos; Rob L. Phillips

(57) ABSTRACT

An automatic card shuffler includes a card input unit, card ejection unit, card separation and delivery unit and card collection unit. A card ejection unit ejects cards in a singular fashion from a stack of cards placed into the input unit. The cards are ejected to a stop arm maintaining the entrance to the card separation unit. Upon processor command, the stop arm raises to allow a plurality of cards to pass under to the card separation and delivery unit. A series of rotating belts and rollers act to separate the cards and propel them individually to the collection unit. A floating gate slightly forward of the stop arm dictates that a minimum number of cards are managed simultaneously. The shuffler is controlled by a processing unit in communication with multiple internal sensors. An audio system communicates voice outputs regarding shuffler malfunctions and instructions to an operator.

14 Claims, 11 Drawing Sheets

U.S. PATENT DOCUMENTS

2003/0075866 A1 4/2003 Blaha et al.
2003/0090059 A1 5/2003 Grauzer et al.
2003/0094756 A1 5/2003 Grauzer et al.
2003/0163125 A1 8/2003 Grauzer et al.

* cited by examiner

AUTOMATIC CARD SHUFFLER

CROSS REFERENCE TO RELATED APPLICATIONS

This application is a continuation of application Ser. No. 10/226,394 filed on Aug. 23, 2002 now U.S. Pat. No. 6,698,756.

FIELD OF THE INVENTION

The present invention relates to devices for shuffling playing cards for facilitating the play of casino wagering games. More particularly, an electronically controlled card shuffling apparatus includes a card input unit for receipt of an unshuffled stack of playing cards, a card ejection unit, a card separation and delivery unit and a collector unit for receipt of shuffled cards.

BACKGROUND

Automatic card shuffling machines were first introduced by casinos approximately ten years ago. Since then, the machines have, for all intents and purposes, replaced manual card shuffling. To date, most automatic shuffling machines have been adapted to shuffle one or more decks of standard playing cards for use in the game of blackjack. However, as the popularity of legalized gambling has increased, so too has the demand for new table games utilizing standard playing cards. As a result, automatic shuffling machines have been designed to now automatically "deal" hands of cards once the cards have been sufficiently rearranged.

For example, U.S. Pat. No. 5,275,411 ("the '411 patent") to Breeding and assigned to Shuffle Master, Inc., describes an automatic shuffling and dealing machine. The '411 patent describes an automatic method of interleaving cards as traditionally done in a manual fashion. Once interleaved, the entire stack of shuffled cards is positioned above a roller that removes and expels a predetermined number of cards from the bottom of the stack to a card shoe. Once the predetermined number of expelled cards are removed from the shoe by a dealer, a second set of cards is removed and expelled. This is repeated until the dealer has dealt each player his or her cards and has instructed (e.g. pressed a button on the shuffler) the shuffling machine to expel the remaining cards of the stack.

The '411 patent and related shufflers, having a dealing means, suffer from the same shortcomings—slowness, misdeals and failure. However, the machines currently marketed are still favored over manual card shuffling. On the other hand, since casino revenue is directly proportional to the number of plays of each wagering game on its floor, casinos desire and, in fact, demand that automatic card shufflers work quickly, reliably and efficiently.

Accordingly, the present invention utilizes a proprietary random card ejection technique in combination with a novel card separation and delivery unit to overcome the aforementioned shortcomings. The present invention uses random ejection technology to dispense individual cards from a card input unit to a card separation and delivery unit of the shuffler. A card stop arm and floating gate control the number of ejected cards that may, at any one time, travel to the card separation and delivery unit. The ejected cards are then separated by a feed roller system which propels the cards to a collection unit. Once a predetermined number of cards are propelled to the collection unit, additional cards are ejected from the card input unit. A shuffler processing unit in communication with internal sensors controls the operation of the shuffler.

An audio system is adapted to communicate internal shuffler problems and shuffler instructions to an operator. Preferably, the audio system is controlled by the shuffler processing unit in communication with a second local processing unit.

SUMMARY

While the objects of the present invention are too numerous to list, several objects are listed herein for reference.

A principal object of the present invention is to provide a reliable and quick card shuffler for poker style card games.

Another object of the present invention is to provide operators with audio outputs of the shuffler's status during use.

Another object of the present invention is to provide operators with audio outputs of shuffler instructions during shuffler use.

Another object of the present invention is to utilize random ejection technology in a shuffler having a means for delivering card hands.

Another object of the present invention is to provide a shuffler having a card delivery means that infrequently, if ever, misdeals (e.g. deal four cards instead of three) or jams.

Another object of the present invention is to decrease the time wasted between deals of any card-based table game.

Another object of the present invention is to provide a shuffler eliminating the need to shuffle an entire deck of cards for each play of the underlying game.

Another object of the present invention is to provide a shuffler having means for accepting and delivering cards of multiple sizes.

Yet another object of the present invention is to provide a shuffler that can deliver card hands of multiple size (e.g. card hands of two to seven cards).

Other objects will become evident as the present invention is described in detail below.

The objects of the present invention are achieved by a shuffler having a card input unit for receipt of unshuffled stacks of playing cards, a card ejection unit, a card separation and delivery unit, a delivery unit and a collection unit for receipt of shuffled cards.

The card input unit is positioned at the rear of the shuffler and adjacent to three card ejectors that randomly push single cards from the unshuffled stack of cards. The input unit is mounted on an output shaft of a linear stepper motor in communication with a shuffler microprocessor. The stepper motor randomly positions a tray of the card input unit with respect to the fixed card ejectors. Each ejector is then activated in a random order such that three cards are ejected from the deck. Once the three cards are ejected, the card input tray is randomly re-positioned, and the three ejectors are once again activated. This process continues until the necessary number of cards for two hands of the underlying game is ejected. The movement of the ejected cards is facilitated by ejection rollers and a downwardly inclined card-traveling surface leading to a collection point, where ejected cards stack behind a stop arm.

The partially rotatable stop arm is spring loaded such that a first end opposite the fixed rotatable end applies pressure in a downward direction onto the card-traveling surface having two parallel card separation belts. The arm is controlled by a motor and cam arrangement that acts to intermittently raise the first end of the stop arm to allow a predetermined number of cards to pass through to the card separation and delivery unit.

The card separation and delivery unit includes a separation belt system, separation rollers and a floating gate. The separation belt system is comprised of two parallel belts residing in a cut-out portion of the card-traveling surface. The separation rollers are above said belts and clutch the cards while the belts remove cards from the bottom of the stack one at time. A floating gate is supported by an elongated member having a first end joined to a first shaft supporting said separation rollers and a second end joined to a second more forward parallel shaft. The floating gate is spaced above the card-traveling surface just rear of the separation rollers and forward of the stop arm so as to prevent no more than 2 or 3 cards from fully passing under the stop arm thereby minimizing misdeals or card jams. A protrusion extending from a bottom portion of the floating gate head is spaced above the card-traveling surface a minimum distance equivalent to the thickness of several playing cards. The floating gate eliminates heretofore common jam and misdeal occurrences. In the unlikely event of a card jam or misdeal, the present shuffler is equipped with multiple internal sensors for detecting the same. Moreover, the sensors are preferably in communication with an audio output system which alerts the operator of the jam or misdeal. In addition, the audio system may be used to instruct an operator during use of the shuffler.

Once the cards are propelled forward by the separation belts, the cards encounter a set of feed rollers. The feed rollers spaced rear of the card collection unit act to feed individual cards into the collection unit. The rotational speed of the feed rollers is faster than the separation belts and rollers so that each card is spaced from the successive card prior to being fed to the collection unit one at a time. The space between the cards is detected by appropriately placed sensors such that the microprocessor stops cards from being fed to the collection unit when a first full hand (e.g. 3, 5, 7 cards) has been collected.

Sensors located in the card collection unit detect the presence of cards in the collection unit. It is from the card collection unit that the operator (e.g. dealer) of the particular card game takes the predetermined number of cards and gives them to a player. Once the cards are removed, sensor outputs cause the microprocessor to instruct the card separation and delivery unit to feed a second hand of cards and the ejector unit to eject another hand of cards. This is repeated until all players have the predetermined number of cards. Once all cards have been ejected and dealt, the operator presses a stop button to cease shuffler operation. Thereafter, once the card game is completed, all dealt cards are placed back on top of the stack of any remaining cards in the card input unit. When ready, the operator presses a go or shuffle button to begin the process for the next game.

Without random ejection technology it has been necessary to expel all cards and re-shuffle all cards for each game played. Therefore, to the delight of players and casinos, the random ejection technology and other features of the present invention dramatically speed up the play of all card games.

BRIEF DESCRIPTION OF THE DRAWINGS

It should be understood that all drawings reflect the present invention with a housing removed.

DETAILED DESCRIPTION

Figure 1:
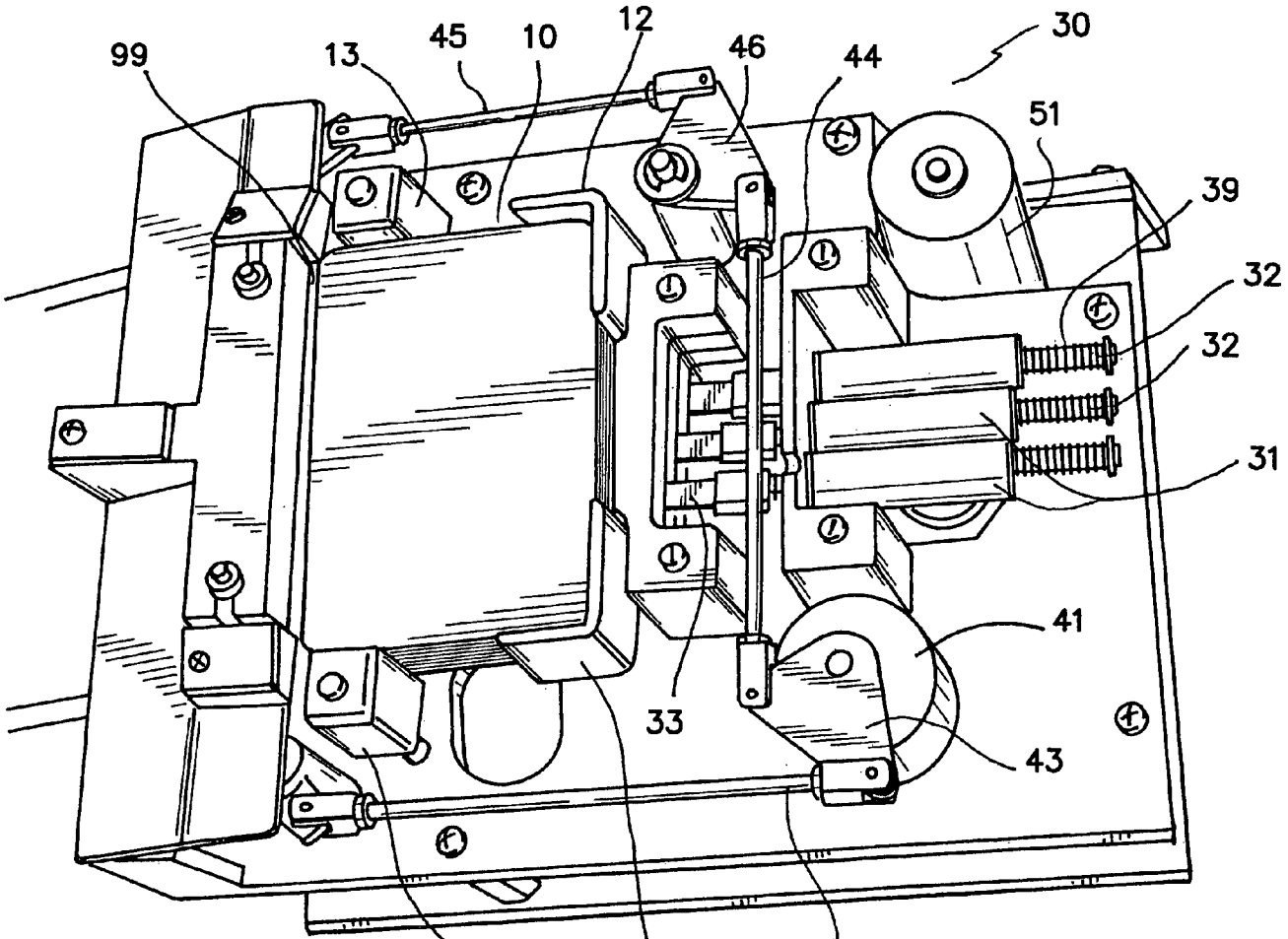
FIG. 1 is a perspective top view of an ejection unit of the present invention.
Figure 1A:
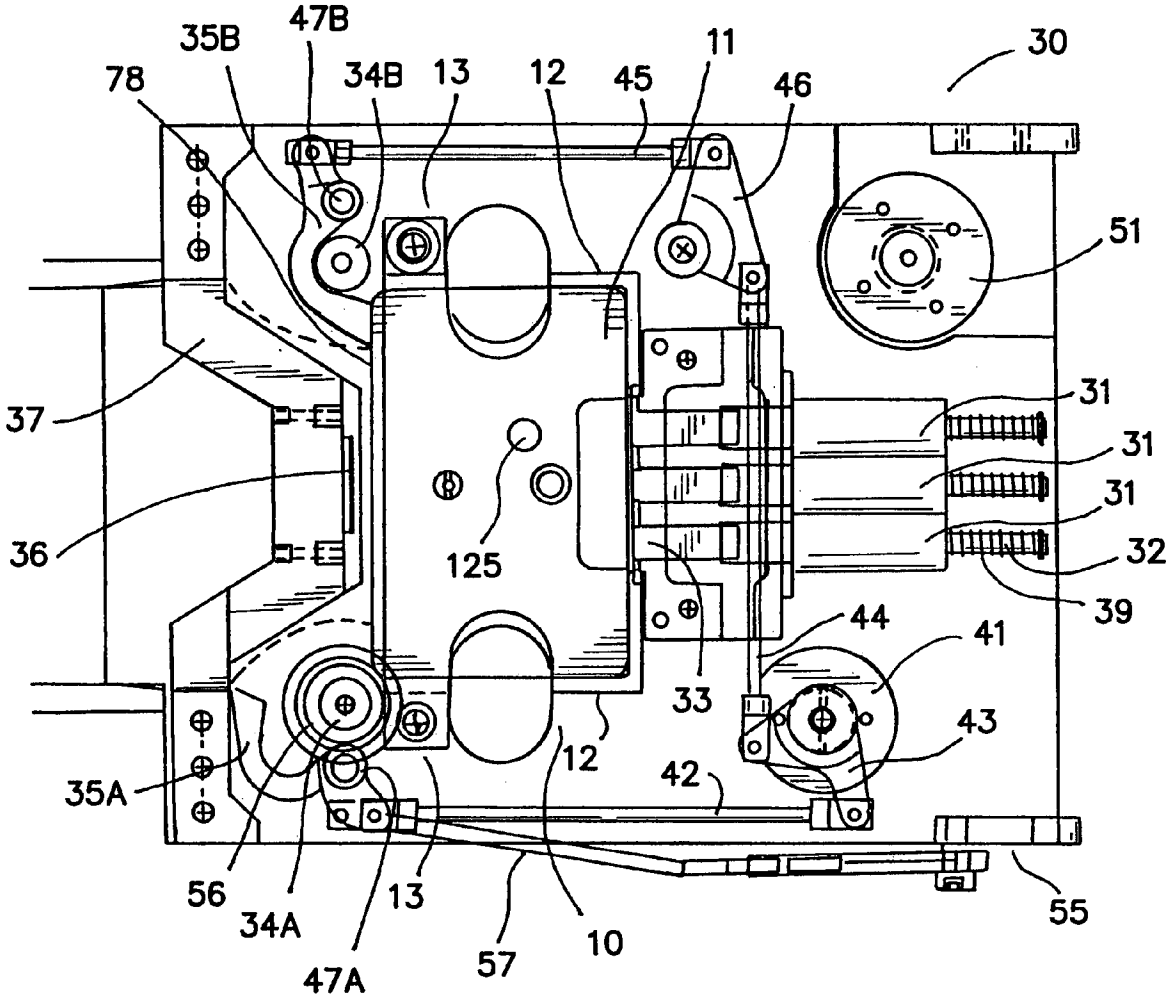
FIG. 1A is a top view of the ejection unit showing internal features of the present invention.

Reference is now made to the figures wherein like parts are referred to by like numerals throughout. FIG. 1 shows an automatic card ejection unit of a card shuffler. In practice, the card shuffler includes a housing to protect and conceal the internal components of the shuffler. The housing includes one or more access points for inputting cards, clearing card jams and for routine service and maintenance procedures. Moreover, the housing includes various operator input means including buttons, switches, knobs, etc., to allow the operator to interact with the shuffler. For example, an on-off button and stop and go buttons will be integrated within said housing.

It should be understood that all operations of the shuffler are controlled by an internal processing unit. Preferably, the processing unit is a microprocessor of the kind known in the art. The shuffler microprocessor is attached to a standard printed circuit board along with other electronic components (e.g. resistors, capacitors, etc.) necessary to support the microprocessor and its operations. The use of a microprocessor to control machines of all types is well-known in the art, and therefore, the specific details are not reiterated herein.

FIGS. 1–4 illustrate a card input unit 10 and card ejection unit 30 of the shuffler. Other shuffler units include a card separation and delivery unit 70 and a collection unit 110 (as shown in FIGS. 5–8A). As referred to throughout, the rear of the shuffler is defined by the card input unit 10 and ejection unit 30 and the front of the shuffler is defined by the collection unit 110.

Figure 2:
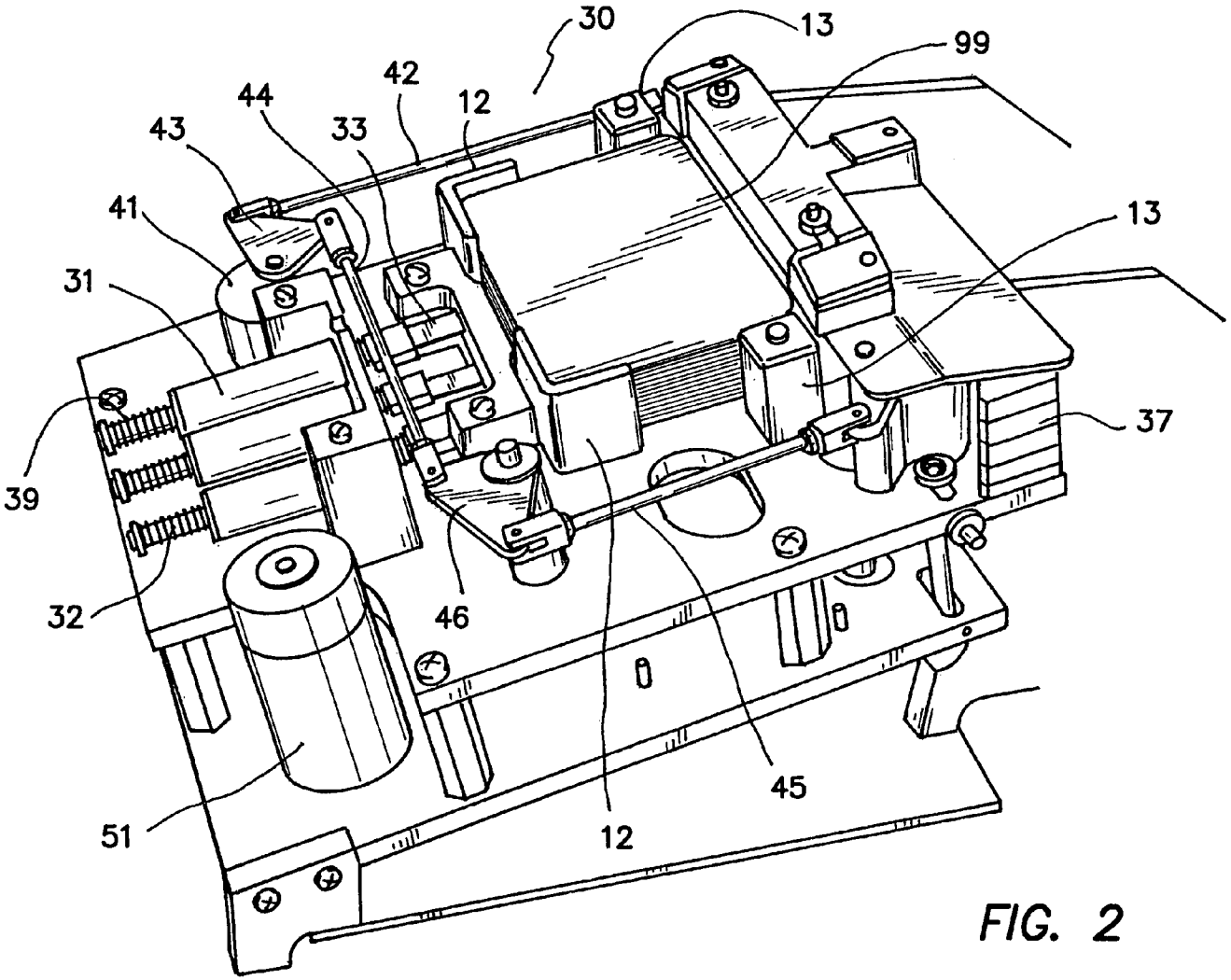
FIG. 2 is a right side view of the present invention showing a card input unit and a card ejection unit.
Figure 3:
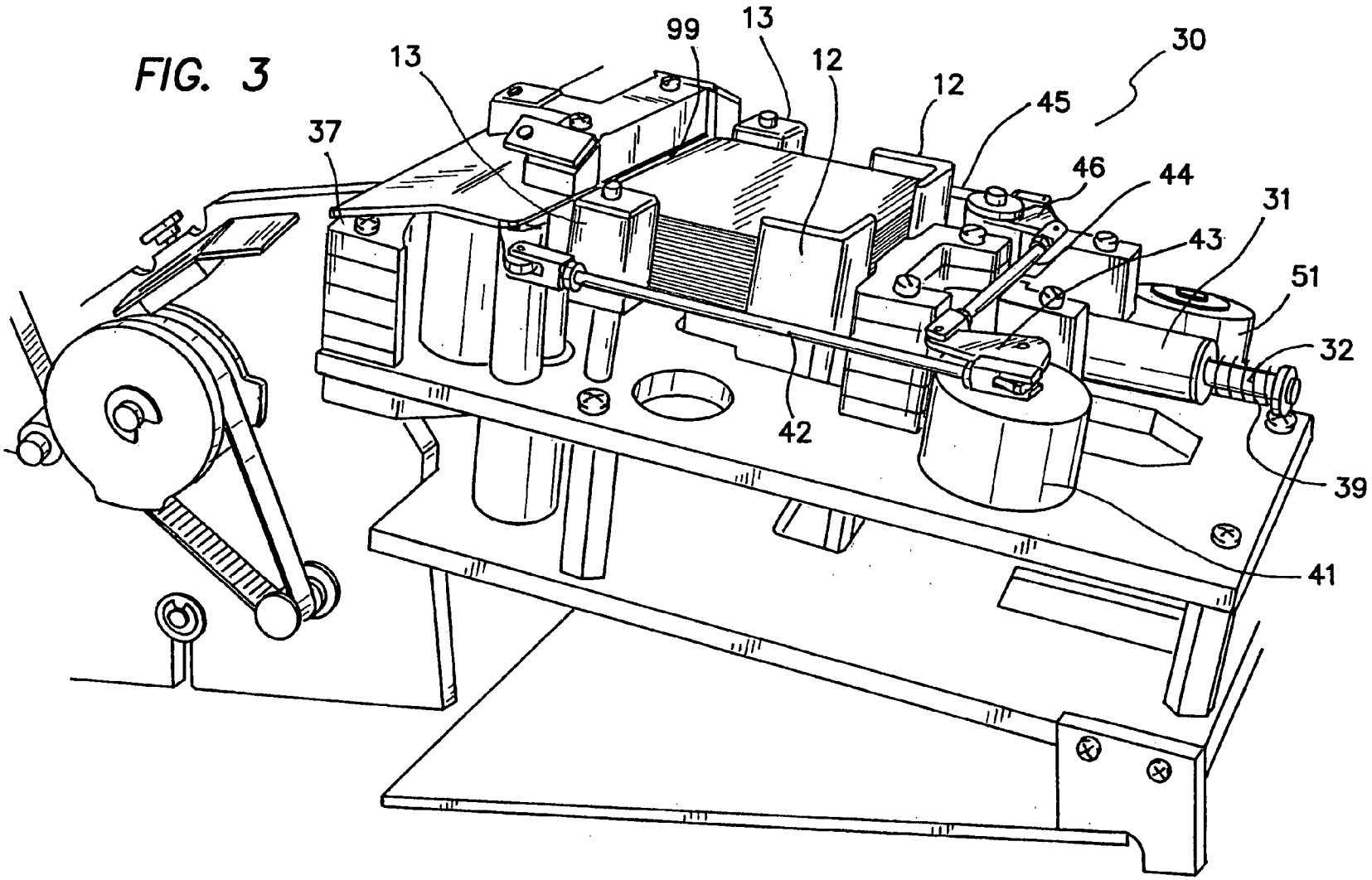
FIG. 3 is a left side view of the present invention showing the card input unit and the card ejection unit.
Figure 4:
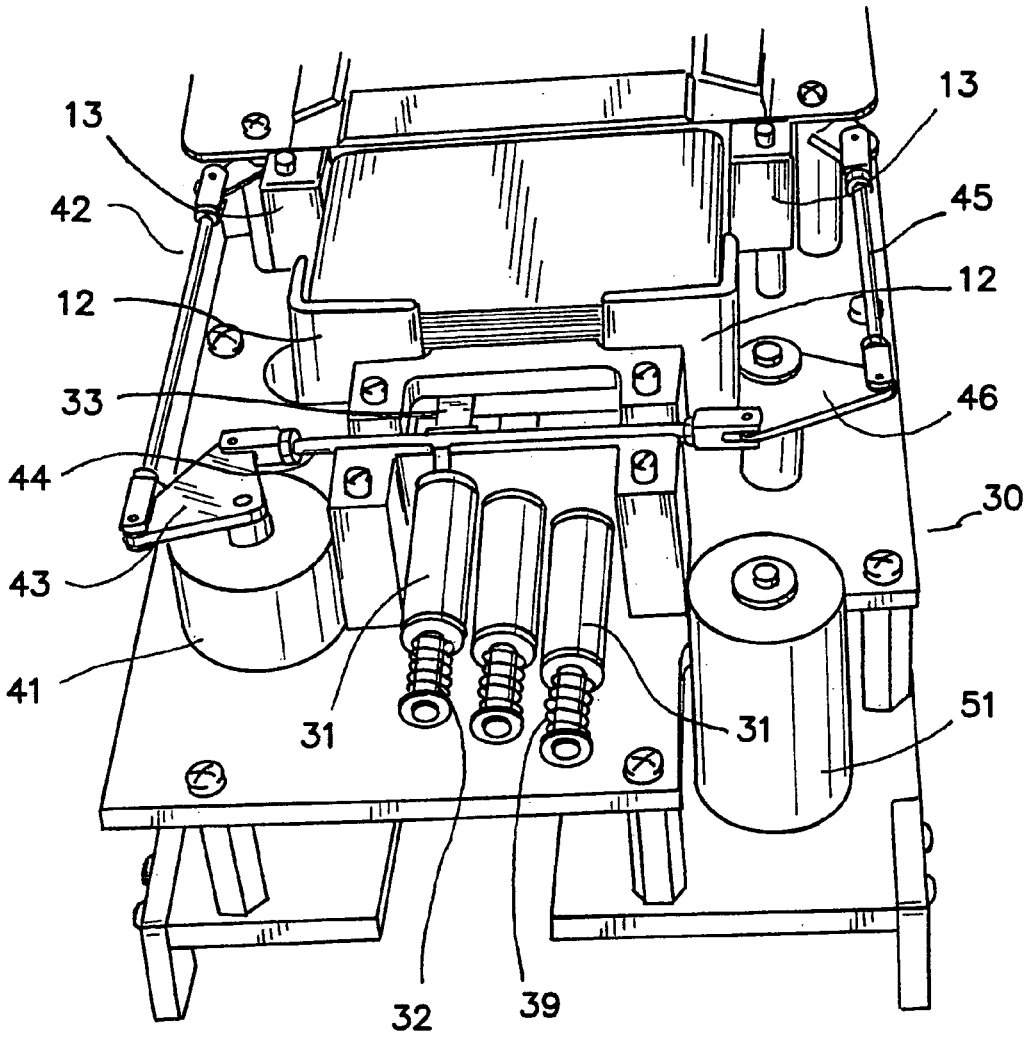
FIG. 4 is a rear view of the present invention showing the card input unit and the card ejection unit.
Figure 5:
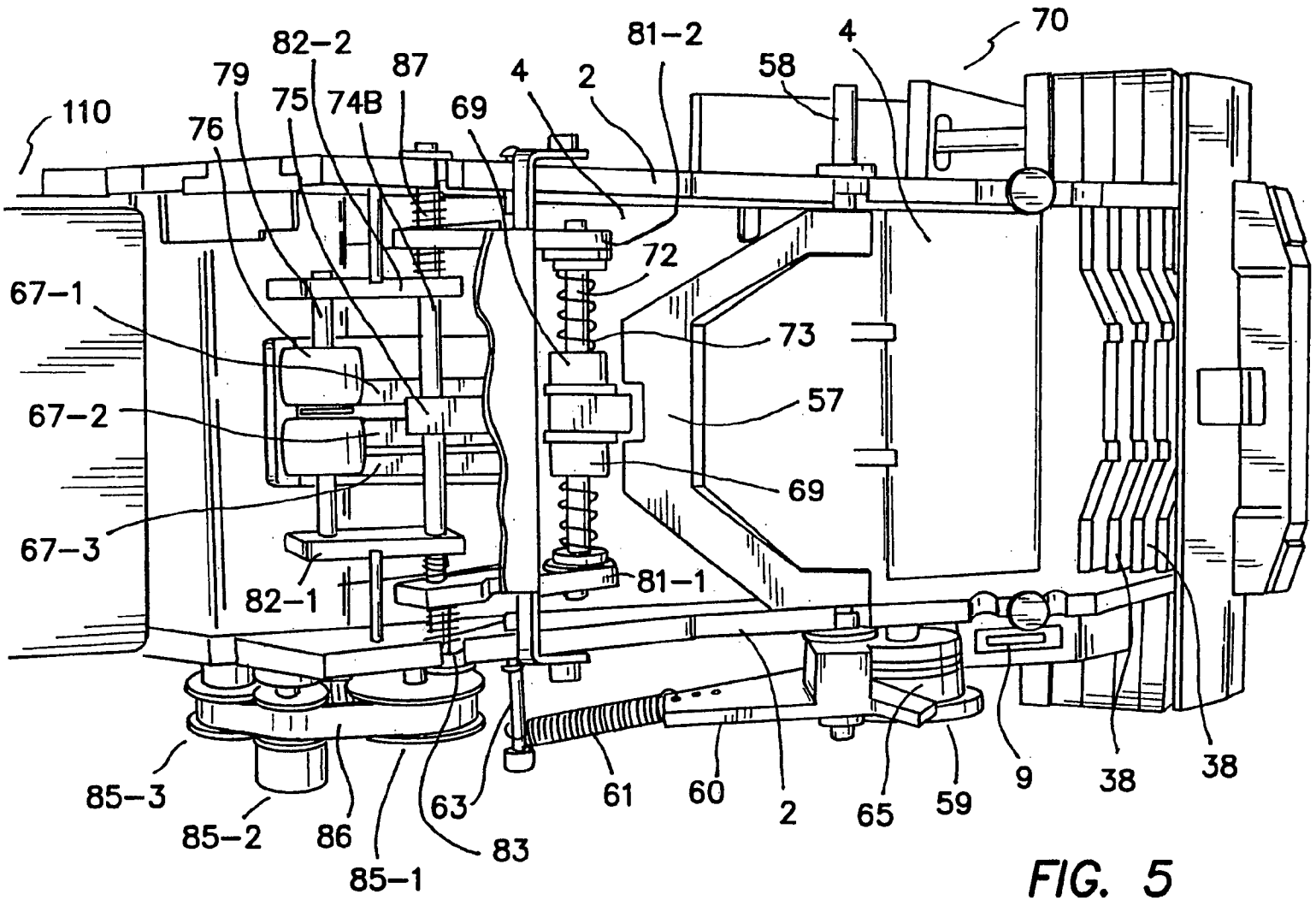
FIG. 5 is a front view of the present invention showing a card separation and delivery unit and a card collection unit.
Figure 6:
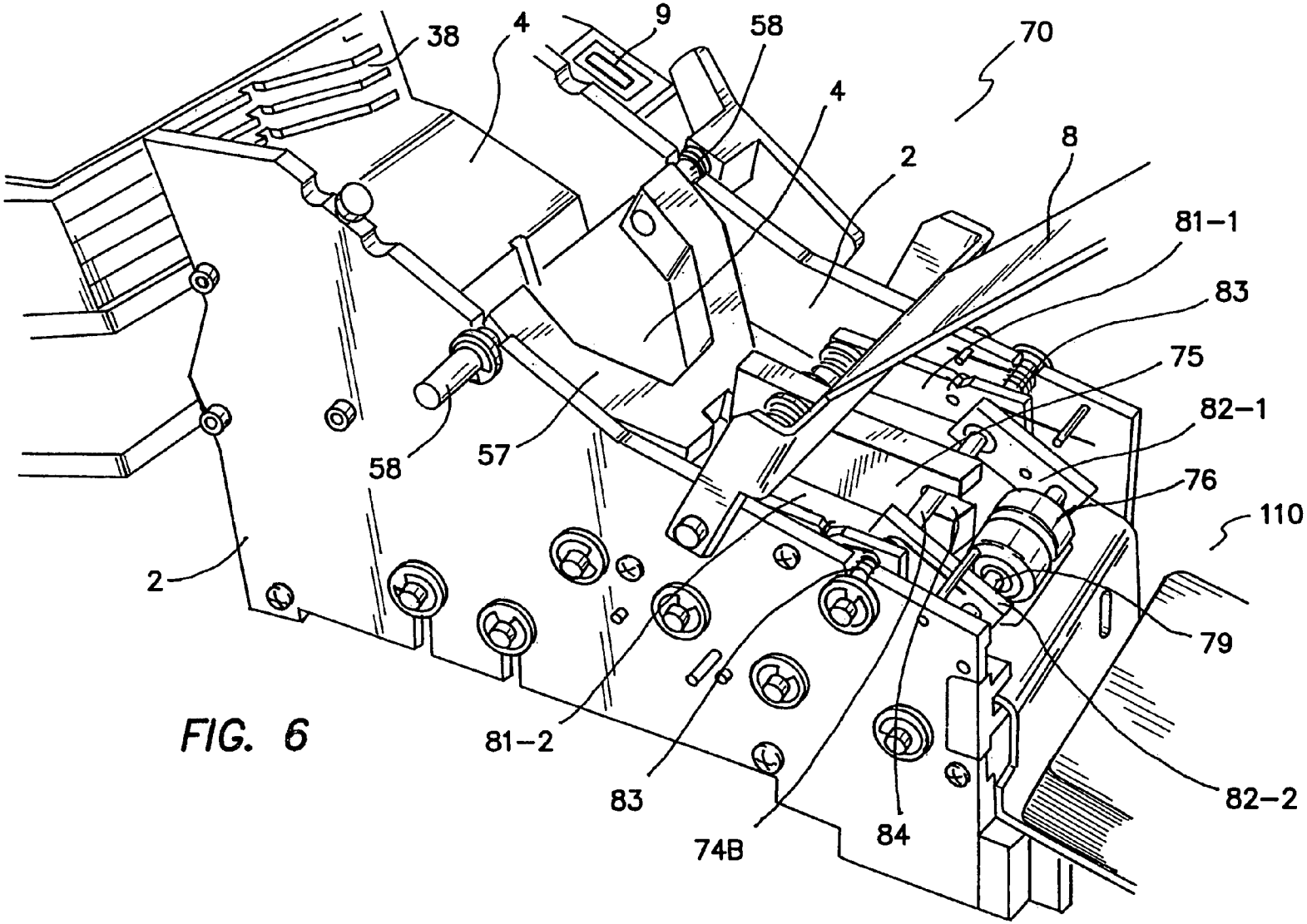
FIG. 6 is a right side view of the present invention showing the card separation and delivery unit and the card collection unit.
Figure 7:
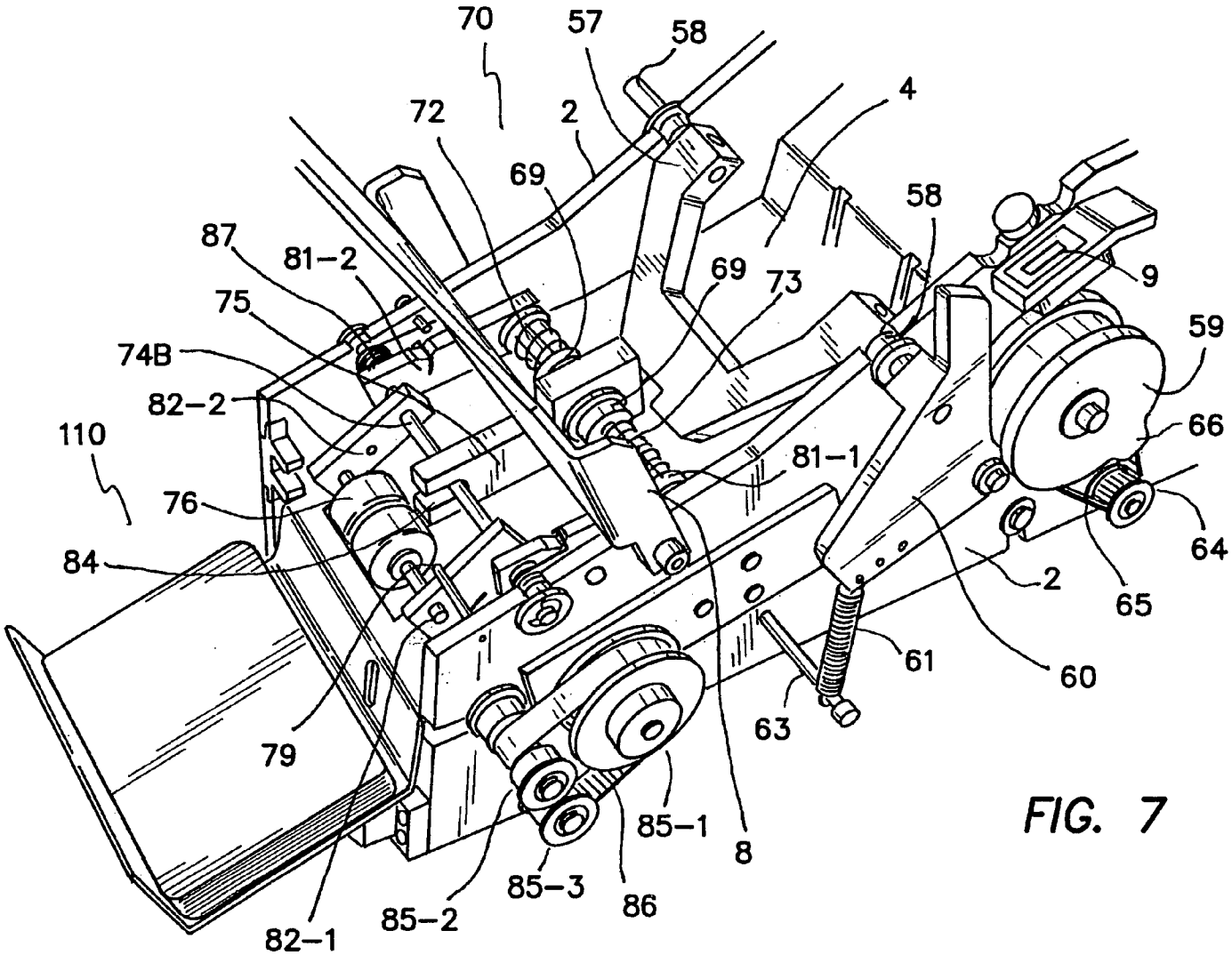
FIG. 7 is a perspective left side view of the present invention showing the card separation and delivery unit and the card collection unit.
Figure 8:
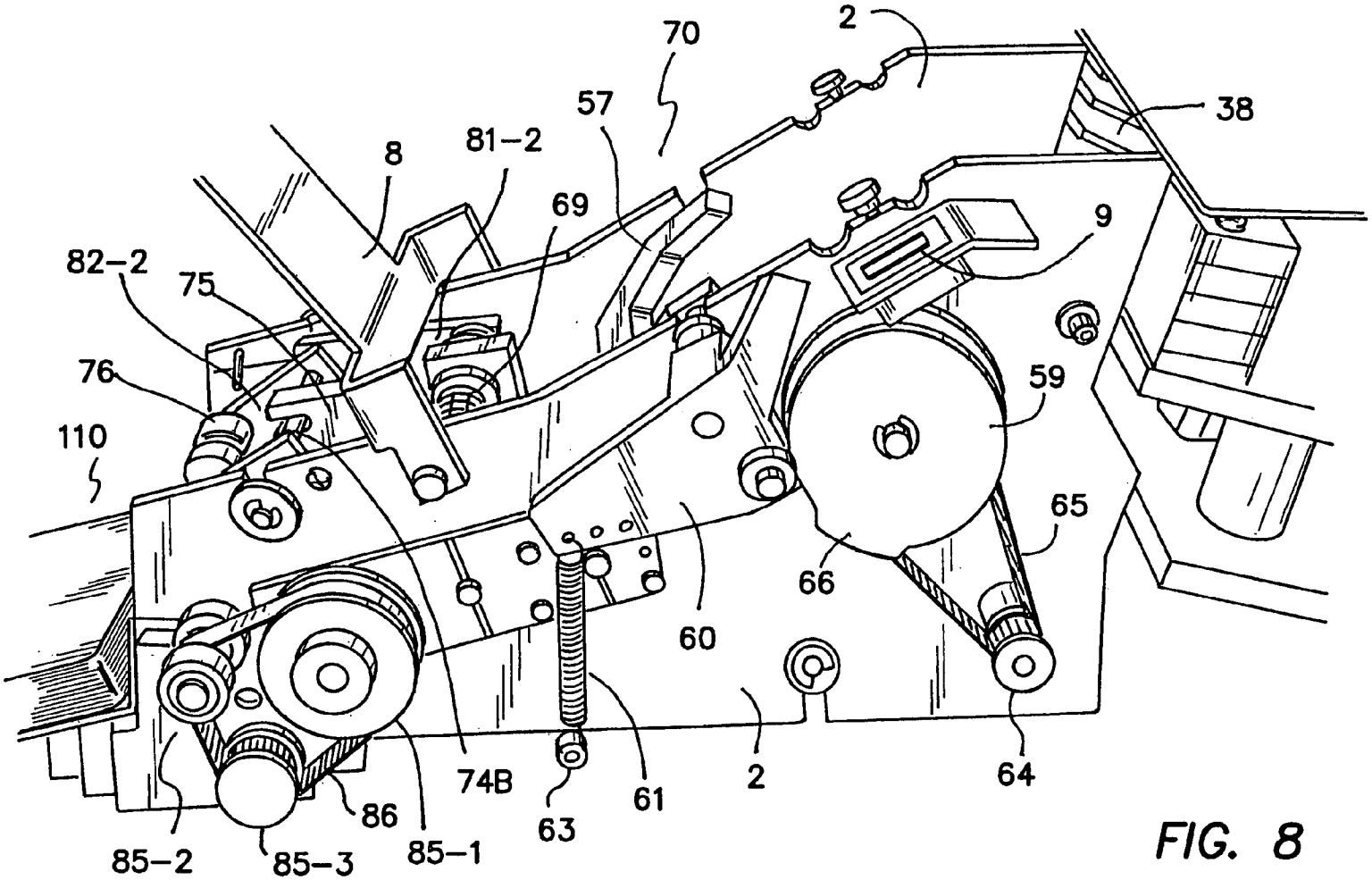
FIG. 8 is a left side view of the present invention showing the card separation and delivery unit and the card collection unit.
Figure 8A:
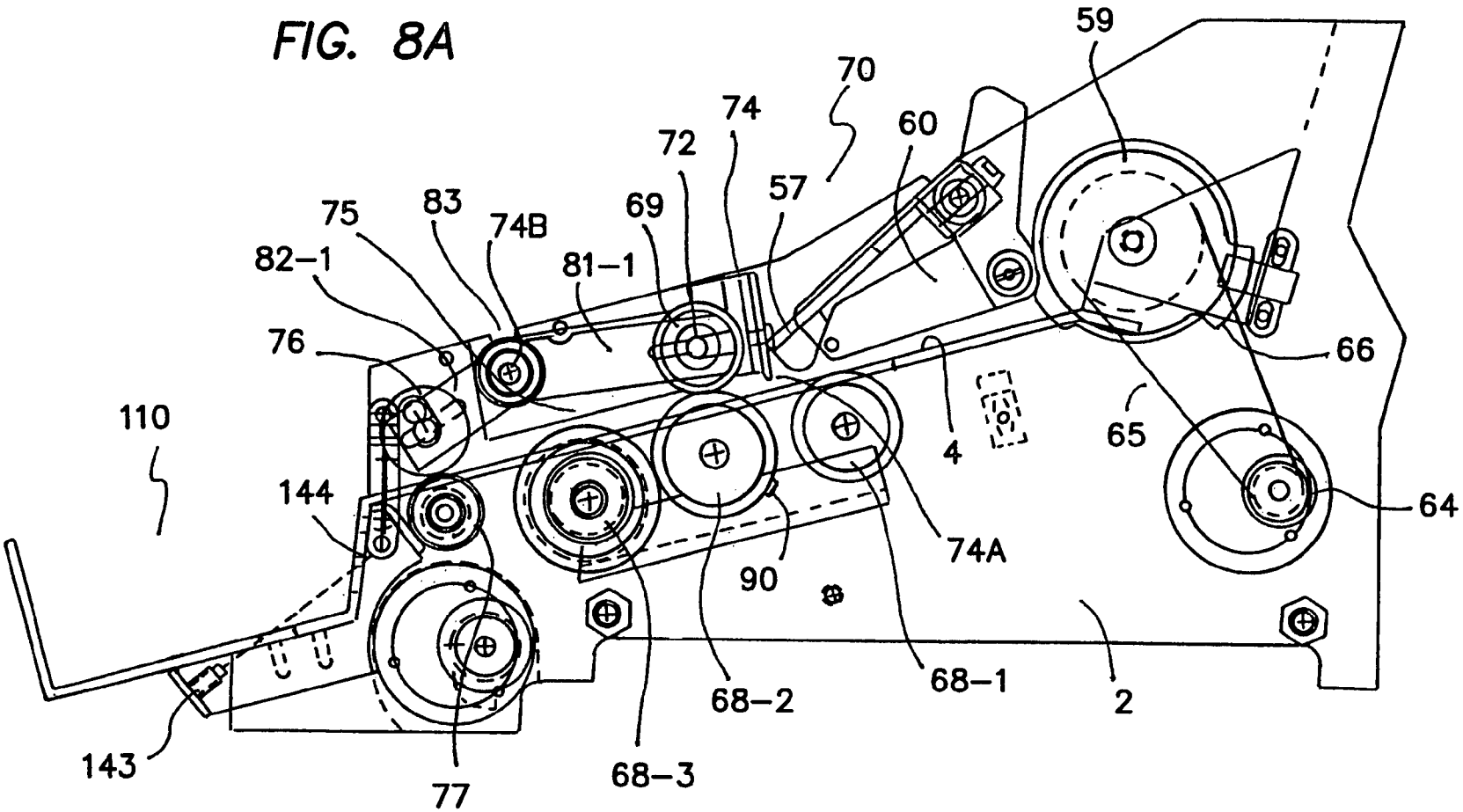
FIG. 8A is a left side view showing internal features of the present invention.

The card input unit 10 comprises a tray 11 having two vertical angled walls 12 and two oppositely placed pillars 13 attached thereto. A stack of cards is initially placed into a recess defined by the angled walls 12 and the pillars 13. As illustrated in FIG. 2, the card input unit 10, more particularly, the underside of the tray 11, is attached to an output arm of a linear stepper motor (not shown). The linear stepper motor randomly raises and lowers the card input unit 10 for reasons that will be fully described below.

U.S. Pat. Nos. 5,584,483 and 5,676,372 assigned to the predecessor in interest of the same assignee as the instant application are incorporated herein by this reference and provide specific details of the random ejection technology implemented in the present invention. The ejection unit 30 comprises three solenoids 31 driving three plungers 32 incorporating ejector blades 33. The solenoids 31 and corresponding ejector blades 33 are each placed at different heights to the rear of the card input unit 10.

Once a stack of cards is loaded into the card input unit 10, an operator presses an external go, deal, shuffle or start button to begin the ejection, separation and delivery process. A card ejecting process begins with the card input unit 10 being raised or lowered to a random location by the linear stepper motor. The random location of the card input unit 10 is based on a random number generated by the shuffler microprocessor or an independent random number generator. An optical sensor insures that the card input unit 10 remains within predetermined maximum and minimum upper and lower input unit 10 positions. Once the card input unit 10 reaches a random location and stops, the solenoids 31 are activated one at a time causing the ejector blades 33 to project into the previously loaded stack of cards. Each blade 33 is designed to eject a single card from the stack. The solenoids 31 are spring biased by springs 39 such that the ejector blades 33 automatically return to their original position after ejecting a card. Upon being ejected from the deck, each ejected card is assisted to the card separation and delivery unit 70 by two oppositely placed roller mechanisms 34A, 34B.

The roller mechanisms 34A, 34B are counter-rotated by a belt drive motor 51 in combination with two idler pulleys. Roller mechanism 34A contacts a first edge of a playing card, and roller mechanism 34B simultaneously contacts a second edge of a playing card. The distance between the roller mechanisms 34A, 34B is adjustable to account for different sized playing cards. A lever 55 protruding through the shuffler housing is joined to an eccentric sleeve 56 by a linkage member 57. The eccentric sleeve 56 is positioned below the roller mechanism 34A and may be raised in response to actuation of lever 55 thereby decreasing the distance between the roller mechanisms 34A, 34B. The adjustability of the roller mechanisms 34A, 34B prevents damage to the cards in any manner. It is imperative that cards not be damaged since damaged cards provide skilled players with an unfair advantage over the casino.

Although the occurrence of card jams is difficult to eliminate, the design of the shuffler drastically reduces and, in fact, minimizes the occurrence of card jams. Preventative measures include rotatable packer arms 35A, 35B and de-doublers 36. The de-doublers 36 are integrated into a de-doubler frame 37 having a plurality of horizontal slots 38 (shown in FIG. 5) for ejected cards to pass through. Each slot 38 incorporates a de-doubler in the form of two vertically-spaced rubber elements 36 arranged in close proximity to prevent more than one ejected card from simultaneously passing through each horizontal slot 38.

In addition, two rotatable card packer arms 35A, 35B are placed adjacent the card input unit 10 adjacent a card eject area and opposite the placement of the solenoids 31. Sensors above and below a leading edge 99 of the card input unit 10 sense the protrusion of any cards from the card input unit 10. In response to the detection of protruding cards, the shuffler microprocessor causes the packer arms 35A, 35B to rotate in the direction of the leading edge 99 of the card input unit thereby forcing the protruding cards back into the proper alignment with the remaining cards in the stack. Each packer arm 35A, 35B is physically joined to a single rotary solenoid 41 by a linkage system. A first linkage member 42 is joined to a first arm of a triangular-shaped joint 43 that is rotatably attached to said rotary solenoid 41. A second end of linkage member 42 attaches to the first packer arm 35A. Second and third linkage members 44, 45 are connected by a triangular-shaped rotatable joint 46 spaced from said rotary solenoid 41. A first end of second linkage member 44 is attached to a second arm of the triangular-shaped joint 43 and a second end is attached to one corner of the rotatable joint 46. The third linkage member 45 is connected to a second opposite corner of the rotatable joint 46 and extends parallel to linkage member 42. The second end of the third linkage member 45 attaches to the second packer arm 35B. As the rotary solenoid 41 is instructed by the shuffler microprocessor to partially rotate in the clockwise direction, the linkage members 42, 45 each force one packer arm 35A, 35B to rotate toward the leading edge 99 of the card input unit 10. The packer arms 35A, 35B each rotate about a pivot 47A, 47B respectively and strike any protruding cards thereby forcing them back into the card stack.

Now referring to FIGS. 5–8A, the card separation and delivery unit 70 is defined by a shuffler frame 2 defines the general shape of the shuffler and includes walls and a card-traveling surface 4 for guiding cards from the card input unit 10 to the card collection unit 110. Cards ejected by the ejection unit 30 traverse a fifteen degree downwardly inclined card-traveling surface 4 and encounter a rotatable U-shaped stop arm 57 blocking an entrance to the card separation and delivery unit 70. The stop arm 57 is spring loaded about pins 58 so that a first end of the stop arm 57 contacts the card-traveling surface 4 temporarily halting the progress of the cards. The shape of the stop arm 57 is such that it facilitates the removal of any cards which may get jammed in the area of the stop arm 57. The cards reaching the stop arm 57 collect and form a stack therebehind. Importantly, the stop arm 57 is positioned such that the stack is staggered to prevent excess cards from passing under the stop arm 57 when the stop arm 57 is briefly and intermittently raised as described below.

A rotatable guide cover 8 resides along an upper section of the frame 2 such that it covers the card-traveling surface 4 from the de-doubler frame 37 to a front portion of the stop arm 57. A forward end of the guide 8 is rotatably joined to the frame 2, and the rear end is releasably engaged, when closed, to magnet 9 attached to an outer surface of the frame 2 rear of the stop arm 57. The guide 8 functions to navigate ejected cards to the stop arm 57 by forming a chamber with the card-traveling surface 4.

The stop arm 57 is motor (not shown) and cam 59 driven whereby the stop arm 57 is intermittently raised from the card-traveling surface 4 allowing a predetermined number of cards to pass. A first one of the pins 58 communicates with a toggle member 60, cam 59 and spring 61 arrangement mounted to an external surface of said frame 2. As the cam 59 is rotated by the motor, a cam node 66 engages and rotates said toggle member 60 thereby causing the stop arm 57 to raise as long as the engagement continues. Once the cam node 66 disengages said toggle member 60 the stop arm 57 is returned to its original position by the spring 61 attached between the toggle member 60 and an elongated extension 63. The rotation of cam 59 is facilitated by pulley 64 and belt 65. The microprocessor controls the timing of the card stop arm 57 by controlling the time of engagement between the cam node 66 and the toggle member 60.

A system of rotatable belts incorporated in a cut-out section 66 of said card-traveling surface 4 and corresponding rollers provide means for propelling the cards from underneath the lifted stop arm 57 to the card separation and delivery unit 70 and ultimately the collection unit 110.

Three parallel and spaced belts 67-1, 67-2 and 67-3 reside slightly above the planar card-traveling surface 4. Now referring to FIG. 8A, three belt pulleys 68-1, 68-2, 68-3 support said spaced belts 67-1, 67-2, 67-3 from underneath the card-traveling surface 4. The front pulley 68-3 is adjustable, in the forward and rear direction, to account for differences in manufactured belts and belt stretching. As cards pass under the lifted stop arm 57, a first end of the rotating belts 67-1, 67-2, 67-3, in combination with two upper separation rollers 69, act to remove and advance only a bottom card from the pack. The upper separation rollers 69 are spring-biased and supported by a first non-rotating shaft 72. Once a card passes between the separation belts 67-1, 67-2, 67-3 and separation rollers 69, the rollers 69 begin to stop rotating since they are no longer being acted upon by the rotating separation belts 67-1, 67-2, 67-3. Additionally, springs 73 provide friction to more hurriedly impede the movement of rollers 69 thereby causing rollers 69 to clutch all but the bottom card in the pack. A nub 90 integrated into a split of the middle belt pulley 68-2 contacts the lower most card in the stack so as to encourage the lower most card in the stack to separate from the stack. Preferably, the nub 90 operates on the bottom most card of the stack one time per revolution of the belt pulley 68-2.

Preferably, a centerline of the middle belt pulley 68-2 is slightly forward of a centerline of the separation rollers 69 so that a trailing edge of each passing card is forced downward by said rollers 69 thereby preventing the next passing card from becoming situated thereunder.

A floating gate 74 is supported by an elongated member 75 fixed at one end to the shaft 72 and a second parallel floating gate shaft 74B spaced forward of the separation roller shaft 72. The floating gate 74 includes a protrusion 74A extending downwardly to prevent more than three cards from fully passing under the stop arm 57 at any given time. In this arrangement, the belts 67-1, 67-2, 67-3 and the rollers 69 only have to manage small (e.g. three) card stacks. Thus, the risk of more than one card being propelled to the card collection unit 110 and causing a misdeal is eliminated. Moreover, the floating gate 74 also controls card jams.

As the cards pass under the floating gate 74 they are propelled by the belts 67-1; 67-2, 67-3 to a pair of upper feed rollers 76 and lower feed rollers 77 which counter-rotate to expel individual cards into the collection unit 110. The upper and lower feed rollers 76, 77 grab opposite surfaces (e.g. the face and back of the card as it traverses the card-traveling surface 4) of each card and propel the card into the collection unit 110. The upper feed rollers 76 are supported by a non-rotating parallel feed shaft 79. The lower feed rollers 77 are driven at a higher speed than belts 67-1, 67-2, 67-3 and rollers 69 so as to create separation between the trailing edge of a first card and the leading edge of a following card. As described below, it is the card separation space that sensors count to verify the number of cards fed into the collection unit 110.

The belts 67-1, 67-2, 67-3 and lower rollers 77 are both driven by a common motor, timing belt and pulley system. A system of three pulleys 85-1, 85-2, 85-3 and a timing belt 86 are mounted on an external surface of the shuffler frame 2 and are driven by a common internal motor. The lower feed rollers 77 are acted upon by pulley 85-2 having a smaller diameter than pulley 85-1 that acts upon belts 67-1, 67-2, 67-3 thereby creating a differential in rotational speeds.

Once the separated cards pass the between rollers 76, 77 they are delivered to the card collection unit 110. The collection unit 110 is inclined downwardly fifteen degrees so that the cards settle at the front of the collection unit 110 for easy retrieval by a dealer.

The separation shaft 72, floating gate shaft 74B, feed shaft 79, separation rollers 69 and upper feed rollers 76 are joined by two pair of elongated bars. A first set of bars 81-1, 81-2 rotatably join the outer portions of the separation shaft 72 to the outer portions of the floating gate shaft 74B. A second set of bars 82-1, 82-2 join the floating gate shaft 74B to the outer portions of the feed roller shaft 79. The floating gate shaft 74B is further supported by opposite notches 83 in the frame 2. In this manner, card jams may be physically cleared by an operator by lifting the floating gate shaft 74B thereby causing the separation shaft 72 to move forward and upward. An open slot 84 in the elongated member 75 further allows the elongated member 75 to be rotated away from the floating gate shaft 74B revealing the card separation and delivery unit 70 for card removal. Springs 87 incorporated between outer surfaces of said first bars 81-1, 81-2 and inner surfaces of the frame 2 return the floating gate shaft 74B to its original position after a card jam is cleared.

Multiple sensors are incorporated throughout the shuffler to track the progression of the cards, inform an operator of shuffler status and to alert the operator of any internal problems. A first, preferably optical reflective, sensor 125 is positioned beneath the card input unit 10 to sense the input of cards into the unit 10. During normal operation the shuffler will not function until sensor 125 detects the presence of cards in card input unit 10. A first pair of sensors (emitter and detector) above and below a leading edge of the card input unit 10 senses the presence of protruding cards from within the card input unit 10. The shuffler microprocessor activates the packer arms 35A, 35B in response to outputs from the first pair of sensors.

A second pair of sensors spaced forward of the first pair of sensors detects the ejection of cards from the card input unit 10. The second pair of sensors detects the number of ejected cards. The number of cards ejected is predetermined based on the underlying card game being dealt. The shuffler microprocessor stops the ejection process once outputs from the second pair of sensors indicate that two hands of cards have been ejected. The number of cards per hand is a function of the underlying wagering game being played. As described below, the shuffler microprocessor re-starts the ejection process in response to an output from a more forward pair of sensors.

Once two hands of cards have been ejected from the card input unit 10, they come to rest, in a staggered stacked fashion, against or adjacent to the card stop arm 57. As the second pack is completely delivered to the card stop arm 57, outputs from the second pair of sensors inform the shuffler microprocessor that the two hands have been ejected and to lift said stop arm 57. The raising of the stop arm 57 permits the previously ejected cards to partially pass under the stop arm 57 to the floating gate 74. Thereafter, the belts 67-1, 67-2, 67-3 and rollers 76, 77 propel the bottom card of the stack to the card collection unit 110 until a first hand has been fed to the card collection unit 110. A third pair of sensors 141, 142 are located adjacent a card exit area such that the pair of sensors 141, 142 detects the number of cards being delivered to the card collection unit 110. Once a first hand is delivered to the card collection unit 110, the shuffler microprocessor, using outputs from the third pair of sensors, stops delivering cards to the card collection unit 110 and re-starts the ejection process. A fourth pair of sensors 143, 144, located in the collection unit 110 detects the presence or absence of cards therein. Once a dealer removes the first card hand from the collection unit 110, the shuffler microprocessor, using outputs from the fourth pair of sensors 143, 144 resumes delivering cards to the card collection unit 110.

The sensor and shuffler microprocessor driven process described continues until the requisite number of hands are delivered to the card collection unit 110 and distributed by the dealer. Once the requisite number of hands has been delivered and dealt, the dealer presses a stop button on the shuffler to stop further card delivery. In an alternative fashion, the shuffler housing may incorporate a re-eject button that the operator may press prior to each hand being ejected. In either embodiment, the ejection unit 30 only need deal the exact number of cards required for the game and number of players playing the game. Thereafter, the ejection technology allows the operator to simply place the played cards on top of the remaining cards in the card input unit 10 and press the go button for the next game. Previous card shufflers require that all cards be shuffled and delivered for each game played. The random ejection technology of the present invention greatly reduces the time between game plays.

Additional sensors are placed along the card separation and delivery unit 70 to detect the occurrence of a card jam or other dealing failure. Upon the determination that a card jam has occurred, the operator can be notified in any number of ways, including the use of LED indicator lights, segmented and digital displays, audio outputs, etc. In one embodiment, the present invention relies on audio outputs in the form of computer generated voice outputs to alert the operator of a card jam or to instruct the operator regarding the status of the shuffler.

As set forth above, the preferred method of notifying a shuffler operator of a card jam or the status of the current shuffle cycle is through an internal audio system. Now referring to FIG. 9, the audio system utilizes a second microprocessor 151, preferably a 32-bit microprocessor, interfaced with the shuffler microprocessor 150. The preferred interface 152 is an RS-232 bi-directional interface. The second microprocessor 151 runs the audio system and a video capture imaging system fully described in co-pending patent application Ser. No. 10/067,794 to the same assignee as the instant application and incorporated herein by reference.

A flash storage card 153 stores digital audio messages, in any language, and communicates said messages to the second microprocessor through a 32-bit bus 154. The messages are retrieved by the second microprocessor 151 in response to commands by microprocessor 150. Microprocessor 150 relies on the outputs of the multiple shuffler sensors for instructing the second microprocessor 151. For example, should a sensor detect a card jam, the output of said sensor will cause microprocessor 150 to communicate with microprocessor 151 instructing the latter that an audio message is required. Microprocessor 151 will then retrieve the appropriate message, possibly a message stating "CARD JAM", from the flash storage card 153 and send the same to a codec 154 (coder-decoder) for converting the retrieved digital audio signal to an analog signal. The analog audio signal is then transmitted via a speaker 155.

The microprocessor 150 also communicates to a flash programmable gate array 157 through a second 32-bit bus 158. The gate array 157 further communicates with a repeat switch 159 incorporated with the shuffler housing. The switch 159 allows an operator to re-play the previous audio message. Said feature is beneficial during shuffler use in a loud casino environment.

It is contemplated that stored audio messages besides "CARD JAM" may include "READY TO SHUFFLE", "REMOVE FIRST HAND", "REMOVE SECOND HAND", "INPUT CARDS", etc. The number of possible audio messages depends solely on the various sensor outputs since the sensors provide microprocessor 150 with the status of the shuffler at any given time. In a more limited application the audio system can be used to communicate game related information, to an operator. For example, the card game known as Pai Gow requires that a number between 1 and 7 be randomly chosen prior to the deal of the game's first hand. The random number determines which player position, and therefore which player, receives the first hand out of the shuffler. Typically dice or random number generators in communication with a display means have been used to generate and communicate the random number to an operator and players. The audio system allows the microprocessor 150 to randomly generate a number between 1 and 7, communicate the number to microprocessor 151, which sends the numberto the codec 154, which causes speaker 155 to output the number in audio form. The repeat switch 159 is very useful in this limited application because the number is absolutely essential to properly play the game of Pai Gow. Therefore, the inability to re-play an unheard or disputed number would cause great confusion and consternation for players.

Figure 9:
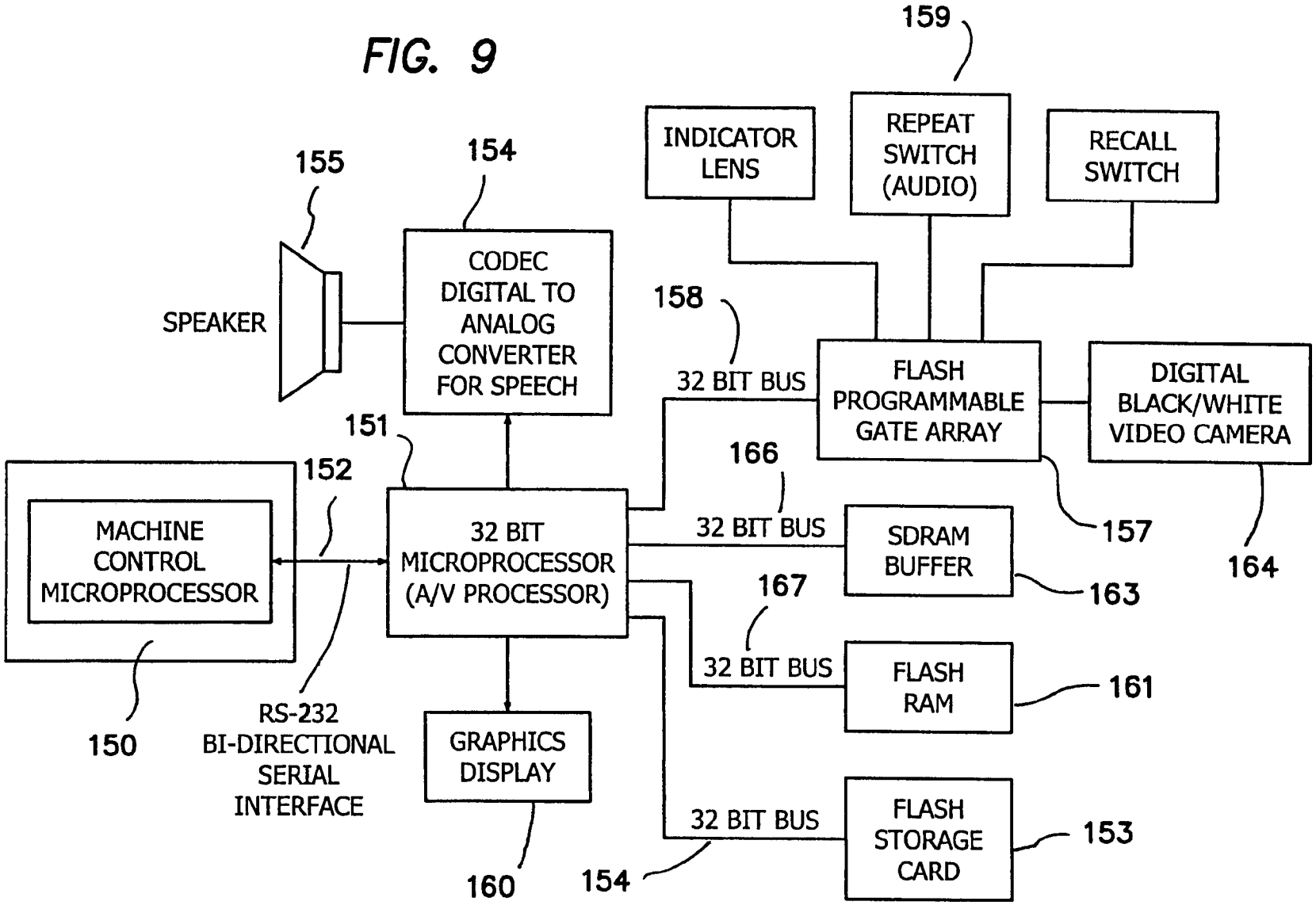
FIG. 9 is a block diagram showing an audio output system of the present invention.

Also illustrated in FIG. 9 are the various components of the image capturing system, including a graphics display 160, flash ram 161, SDRAM buffer 163, digital (black/white) video camera 164 and hand recall switch 165. The flash ram 161 initially stores digital images of every dealt card as they are captured by the digital camera 164. The SDRAM buffer 163 then stores and assembles the captured images. The images captured by the digital camera 164 are sent to the gate array 157 which uses gray scale compression to compress the images. The compressed images are then sent via 32-bit bus 158 to microprocessor 151 which then sends the compressed images to the SDRAM buffer and/or the flash memory 161 via 32-bit buses 166, 167. When desired the operator presses the hand recall switch 165 incorporated in the shuffler housing to display the captured images, in order of deal, on display 160.

Although the invention has been described in detail with reference to a preferred embodiment, additional variations and modifications exist within the scope and spirit of the invention as described and defined in the following claims.

We claim:

1. An apparatus for randomly arranging and dealing a plurality of playing cards comprising:

a random card ejection unit for randomly ejecting cards from a first stack of playing cards;

a card separation unit;

a stop arm positioned rear of said card separation unit for causing said ejected cards to form a second stack in an off-set arrangement rear of said card separation unit;

a card delivery unit for receipt of playing cards separated from said second stack of cards; and a card collection unit for receipt of cards from said delivery unit.

2. The apparatus of claim 1 further comprising an adjustable limiting means for controlling a number of ejected playing cards having concurrent access to said card separation unit.

3. The apparatus of claim 2 wherein said adjustable limiting means is a floating member positioned forward of said stop arm.

4. The apparatus of claim 3 wherein said floating member prevents more than three playing cards from having concurrent access to said separation unit.

5. The apparatus of claim 1 further comprising an audio unit, including a speaker, for generating voice outputs related to apparatus status.

6. The apparatus of claim 5 wherein the apparatus status includes at least one voice output from the group consisting of a card jam indication, ready to shuffle indication, complete hand in the collection unit indication, remove cards in the collection unit indication and input cards indication.

7. An apparatus for randomly arranging and dealing a plurality of playing cards comprising:

a random card ejection unit for randomly ejecting cards from a plurality of playing cards;

a card separation unit;

an adjustable limiting means for controlling a number of ejected playing cards having simultaneous access to said card separation unit;

a card delivery unit for receipt of playing cards separated from a stack of cards rear of the card separation unit; and a card collection unit for receipt of cards from said delivery unit.

8. The apparatus of claim 7 further comprising a stop arm rear of said card separation unit for causing said ejected cards to stack in a staggered arrangement rear of said card separation unit and said adjustable limiting means.

9. The apparatus of claim 8 wherein said stop arm is systematically raised thereby allowing one or more playing cards in the stack access to said separation unit.

10. The apparatus of claim 9 further comprising an audio unit for generating voice outputs related to apparatus status.

11. The apparatus of claim 10 wherein the apparatus status includes at least one voice output from the group consisting of a card jam indication, ready to shuffle indication, complete hand in the collection unit indication, remove cards in the collection unit indication and input cards indication.

12. An apparatus for randomly arranging playing cards comprising:

a card ejection unit; and an audio system for generating voice outputs related to a status of the apparatus.

13. The apparatus of claim 12 wherein the status of the apparatus includes at least one voice output from the group consisting of a card jam indication, ready to shuffle indication, complete hand in the collection unit indication, remove cards in the collection unit indication and input cards indication.

14. The apparatus of claim 12 wherein the audio system generates voice outputs in the form of instructions related to operation of the apparatus.

* * * * *